US007607548B2

(12) United States Patent
Dagn

(10) Patent No.: US 7,607,548 B2
(45) Date of Patent: Oct. 27, 2009

(54) CLOSURE CAP, ESPECIALLY FOR CLOSING THE CONNECTION OF AN OIL FILTER

(76) Inventor: Josef Dagn, Schwondter Str. 10 A-6345, Kössen (AT)

( * ) Notice: Subject to any disclaimer, the term of this patent is extended or adjusted under 35 U.S.C. 154(b) by 575 days.

(21) Appl. No.: 10/514,340

(22) PCT Filed: May 13, 2003

(86) PCT No.: PCT/EP03/04993

§ 371 (c)(1),
(2), (4) Date: Dec. 8, 2005

(87) PCT Pub. No.: WO03/095065

PCT Pub. Date: Nov. 20, 2003

(65) Prior Publication Data

US 2006/0086747 A1 Apr. 27, 2006

(30) Foreign Application Priority Data

May 13, 2002 (DE) ..... 202 07 474 U

(51) Int. Cl.
*B65D 41/01* (2006.01)
*B65D 41/04* (2006.01)
*B65D 53/02* (2006.01)

(52) U.S. Cl. ..... 215/293; 215/319; 215/334; 220/287; 220/304

(58) Field of Classification Search ..... 220/323, 220/287, 304, 326, 378; 215/293, 319, 318, 215/334
See application file for complete search history.

(56) References Cited

U.S. PATENT DOCUMENTS

| | | | | |
|---|---|---|---|---|
| 893,469 A | | 7/1908 | Essmuller | |
| 1,556,020 A | * | 10/1925 | Noll | 215/332 |
| 1,702,476 A | * | 2/1929 | Kucera | 215/334 |
| 2,262,021 A | * | 11/1941 | Lockwood | 215/334 |
| 2,398,553 A | * | 4/1946 | Nyden | 215/334 |
| 2,414,395 A | * | 1/1947 | Salvo | 215/334 |
| 2,456,448 A | * | 12/1948 | Ross | 215/334 |
| 3,044,651 A | * | 7/1962 | Friedman | 215/44 |
| 5,044,521 A | * | 9/1991 | Peckels | 222/23 |
| 5,305,906 A | * | 4/1994 | Dietrich et al. | 220/288 |
| 5,950,851 A | * | 9/1999 | Clodfelter et al. | 215/334 |
| 6,854,616 B2 | * | 2/2005 | Steffan | 220/270 |
| 6,978,803 B2 | * | 12/2005 | Brown et al. | 138/96 R |
| 7,100,785 B1 | * | 9/2006 | Suffa | 215/330 |

FOREIGN PATENT DOCUMENTS

| | | |
|---|---|---|
| DE | 826 557 C | 1/1952 |
| DE | 21 25 746 A | 12/1972 |
| DE | 42 36 050 A | 11/1993 |
| FR | 1 121 209 A | 7/1956 |
| FR | 2 755 951 A | 5/1998 |
| WO | WO 02 02048 A | 1/2002 |
| WO | WO 02 28344 A | 4/2002 |

* cited by examiner

*Primary Examiner*—Anthony D Stashick
*Assistant Examiner*—Niki M Eloshway
(74) *Attorney, Agent, or Firm*—Knobbe Martens Olsen & Bear LLP

(57) ABSTRACT

The invention relates to a closure cap, especially for closing a screw neck of an oil filter connection in motor vehicles. An elastically expandable nut element (5,20) is arranged in the closure cap. Said nut element is such that it can be placed on screw necks (3) of various diameters, engaging with the outer thread of the screw neck.

5 Claims, 4 Drawing Sheets

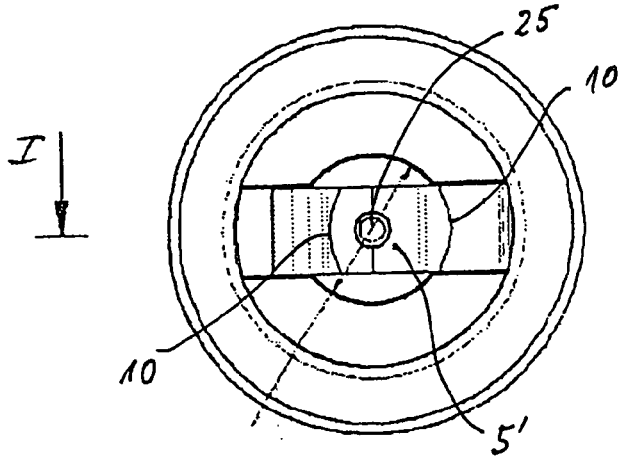
Fig. 8
Fig. 9
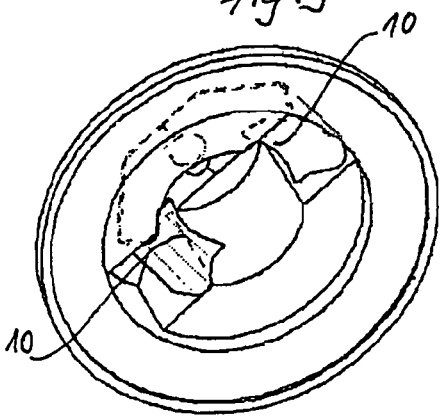
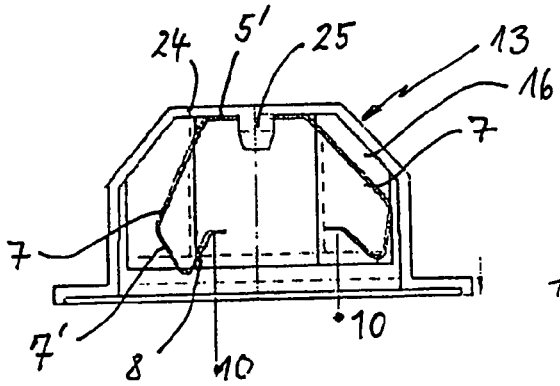
Fig. 7

CLOSURE CAP, ESPECIALLY FOR CLOSING THE CONNECTION OF AN OIL FILTER

The invention relates to a closure cap which is especially provided for closing an oil filter connection in motor vehicles.

When disposing of old vehicles, the oil in the engine is drawn off and the oil filter is screwed off. However, old oil remains in hollow spaces in the engine and can run out through the oil filter connection during the further handling of the engine. Therefore, a closure cap is mounted on the oil filter connection. As the screw necks of oil filter connections have different diameters according to the different types of vehicle, different sizes of closure cap must be provided.

The invention is based on the object of designing a closure cap such that screw necks of different diameter can be reliably sealed.

This object is solved according to the invention by a closure cap according to claim 1. Because the closure cap has an elastically expandable nut element, the closure cap can be screwed onto screw necks of different diameter, so that only one closure cap needs to be provided for different types of vehicle.

The invention is exemplarily explained in more detail with reference to the drawing, in which FIG. 1 shows a section of a closure cap screwed onto a screw neck;

FIG. 7 shows a preferred embodiment of a closure cap having an inserted spring clip;

FIG. 8 shows a view of the closure cap in FIG. 7 from below;

FIG. 9 shows a perspective view of the closure cap according to FIGS. 7 and 8 from below;

The approximately hat-shaped closure cap 1 consists preferably of plastic and has a flange portion 2 which comes to bear on a surface 3*a* surrounding the screw neck 3. On the flange portion 2, a ring seal 4 is provided which seals the screw neck 3 to prevent leakage of oil after the closure cap 1 has been screwed onto the screw neck 3.

Figure 1:
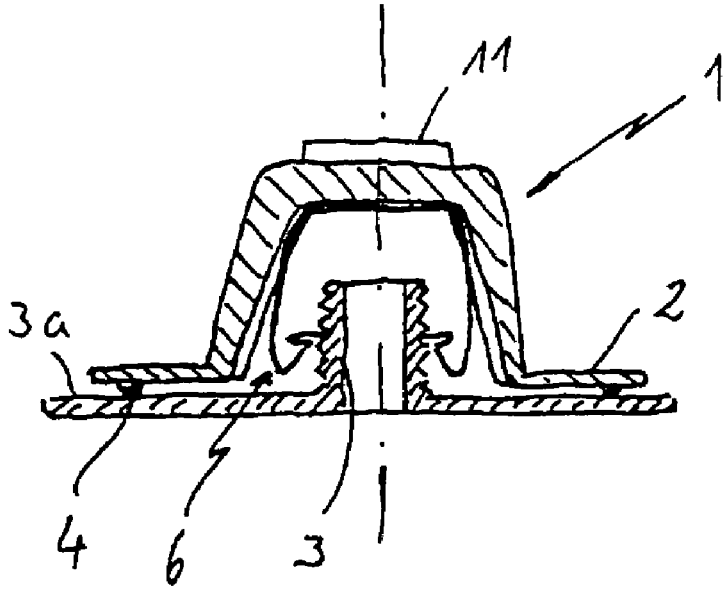
Figure 2:
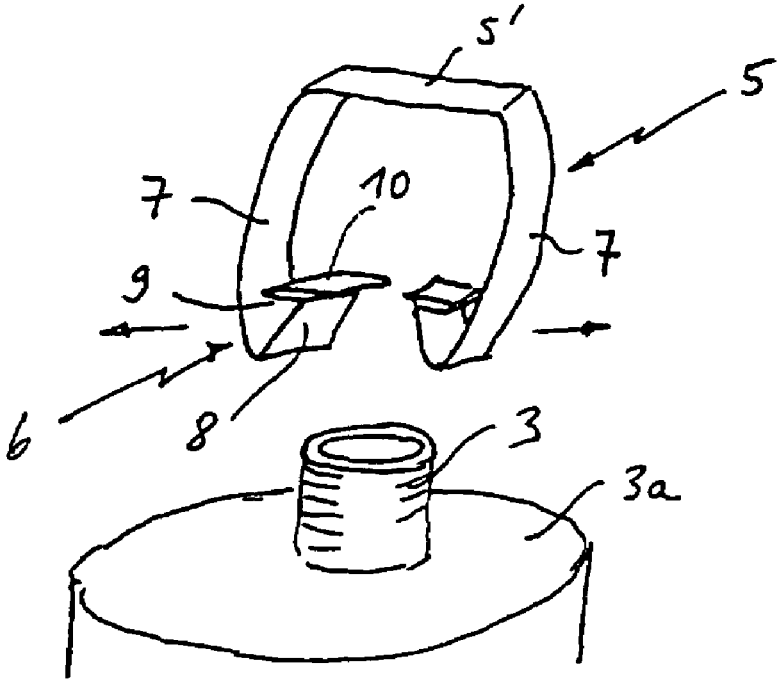
FIG. 2 shows a perspective view of the nut element insertable in the closure cap over a screw neck of an oil filter connection.

In the closure cap 1, inserted in diametrically opposite grooves extending in an axial direction is a nut element 5 in the form of a spring clip shown in FIG. 2, having an elastically expandable screw engaging portion 6 on diametrically opposite spring arms 7. In the embodiment shown, the free ends of the spring arms 7 are bent inwards to give inclined surfaces 8 which merge into a horizontal section 9, which extends radially outward. From each radially outward end of the horizontal section 9, a portion 10 is bent inward, which also extends approximately horizontally, that is, approximately to the longitudinal axis, and is positioned somewhat inclined in relation to the longitudinal axis, so that the free edge of the portion 10 corresponds to a section of a thread. Preferably, the edge of the portion 10 is formed arc-shaped in the view along the axis of the closure cap.

On mounting the closure cap on a section of thread, first the inclined surfaces 8 come to bear on the outer circumference of the screw neck 3, whereupon, when the closure cap 1 is pressed on, the lower ends of the spring arms 7 are displaced radially outwards until the engaging portion 10 can engage with the thread on the outer circumference of the screw neck 3. For this purpose, the free edge of the portion 10 protrudes beyond the inner edge of the inclined surface 8. After that, the closure cap is screwed on until the flange portion 2 having the ring seal 4 comes to bear on the surface 3*a*.

The seal of the screw neck 3 can be formed by inserting an oil retainer ring on the inside of the closure cap 1, for example in the area of the stay 5' of the spring clip. Preferably, the seal is provided on the outside of the closure cap on the flange portion 2 in the form of the ring seal 4, so that the seal is independent of the diameter of the screw neck 3 and the functioning of the elastically expandable nut element 5 is not hindered.

Different modifications of the described embodiment are possible. For example, instead of a two-arm spring clip 5, a nut element can also be provided which has a plurality of elastically deformable arms which are distributed over the circumference and which are provided with one or a plurality of engaging portions.

The stay section 5' of the approximately U-shaped spring clip formed from a strip of resilient material can serve to fix the spring clip in the closure cap, for example by riveting or bonding. Preferably the arms 7 of the spring clip are additionally guided in longitudinal grooves 16 (FIG. 4) on the inner circumference of the closure cap so that they are joined to it in such a way as to avoid rotation.

On the outside of the closure cap, a hexagon step 11 can be formed so that a tool for screwing on the closure cap can be attached.

Figure 3:
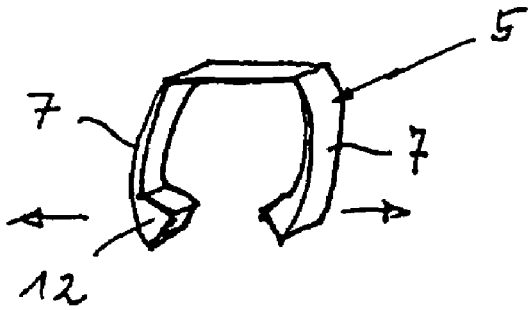
FIG. 3 shows a modified embodiment of a nut element.

Instead of the thread engaging portion 10 on the spring clip 5, the inside edge of the inclined surface 8 can also be designed as an engaging portion, as FIG. 3 shows schematically for a plastic clip, whose diametrically opposite arms 7 have triangular ribs 12 which can be displaced radially outwards in the direction of the arrows to be able to engage with the thread.

FIG. 7 shows an embodiment having a spring clip 5 in which the thread engaging portion 10 is formed by a bending of the free edge of the inclined surface 8.

Figure 4:
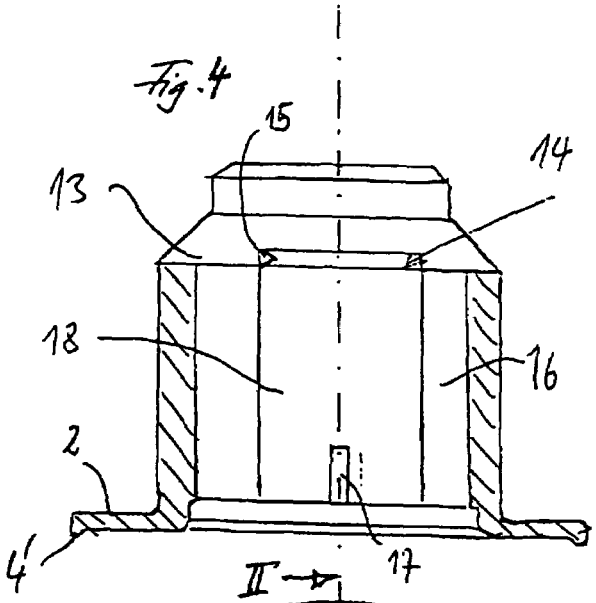
FIG. 4 shows a partial longitudinal section along the line I-I in FIG. 5 through a plastic cap without an inserted spring clip.
Figure 5:
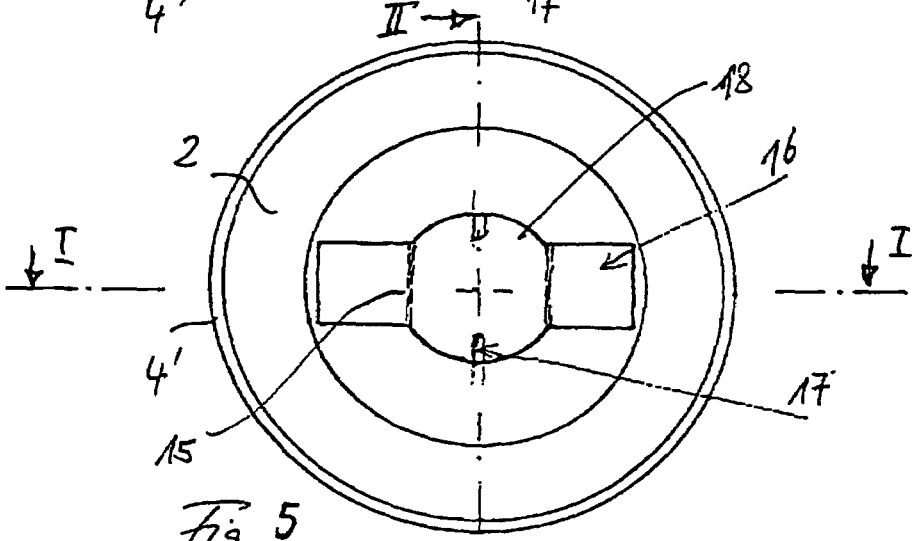
FIG. 5 shows a view of the closure cap in FIG. 4 from below.

FIG. 4 shows in a partial longitudinal section a plastic cap 13 along the line I-I in FIG. 5, in which on the outer edge of the flange portion 2 a plastic sealing lip 4' is formed. Instead of the sealing lip 4', an O-ring can also be inserted in a groove of the plastic. A recess 14 is provided on the inside for inserting the spring clip 5. Plastic projections 15 are provided at opposite positions in this recess 14, and on these the stay section 5' of the spring clip snaps in by pressing, so that a separate connecting element is not required.

In FIGS. 4 and 5, lateral guide grooves 16 for the spring arms 7 (FIG. 2) are provided, by which the spring clip 5 is held in a rotation-proof way in the cap 13.

Figure 6:
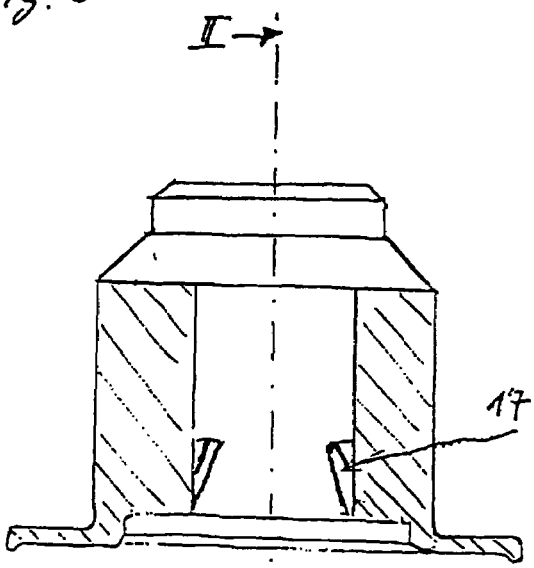
FIG. 6 shows a sectional view along the line II-II in FIG. 5.

FIG. 6 shows in a sectional view rotated by 45° along the line II-II in FIG. 5 diametrically opposite plastic lips 17 which merely serve for centring a screw neck having a small diameter. When a closure cap is mounted on a screw neck having a small diameter, these plastic lips 17 are displaced to the side, wherein they can also break off. They serve merely as a threading aid.

In the embodiment of a plastic cap 13 shown in FIGS. 4 to 6, the cylindrical inside designated 18 is designed such that it can receive the largest diameter of a screw neck. The engaging sections 8, 10 of the spring arms 7 in the grooves 16 here extend into the cylindrical hollow space 18, so that they can also engage with a screw neck having a smaller diameter.

FIGS. 7 to 9 show a preferred embodiment of a closure cap, wherein on the inside of the front wall 24 of the plastic cap 13 which is transverse to the longitudinal axis, a pin 25 is formed on which the spring clip 5 is mounted. For this purpose, the spring clip has on the stay portion 5' a bore for receiving the pin 25. Preferably a snap-in connection is provided so that the spring clip mounted on the pin 25 cannot fall out when the closure cap is being handled. It is also possible, instead of providing a round pin, to provide a polygonal cross section of the pin, so that additionally to the holding function, a rotation-proofing of the spring clip relative to the cap is achieved. Additionally, however, the spring clip is guarded from twisting relative to the cap by the spring arms 7 in the grooves 16.

In FIG. 7, the left spring arm 7 is shown in a starting position in which the engaging portion 10 engages with the outer thread of a screw neck 3 having a minimum diameter, while the right spring arm 7 in FIG. 7 is shown in a position in which it engages with the thread of a screw neck having a maximum diameter. FIG. 8 also shows in a view from below in FIG. 7 these two end positions of the spring clip, wherein the bent edge of the engaging portion 10 is also shown which is also recognizable in the perspective view of the closure cap in FIG. 9 from below.

Preferably, the spring arms 7 in the engaging area are formed approximately V-shaped between the inclined surface 8 and a bent portion 7', as FIG. 7 shows, to improve the elasticity in the engaging area. Hereby, the radially outward area of spring ams 7 can abut on the inner wall of the groove 16 when a maximum diameter of a screw neck 3 is received, as the right-hand side in FIG. 7 shows, wherein due to the V-shape of the engaging portion, sufficient elasticity still exists for engagement on the screw neck.

Figure 10:
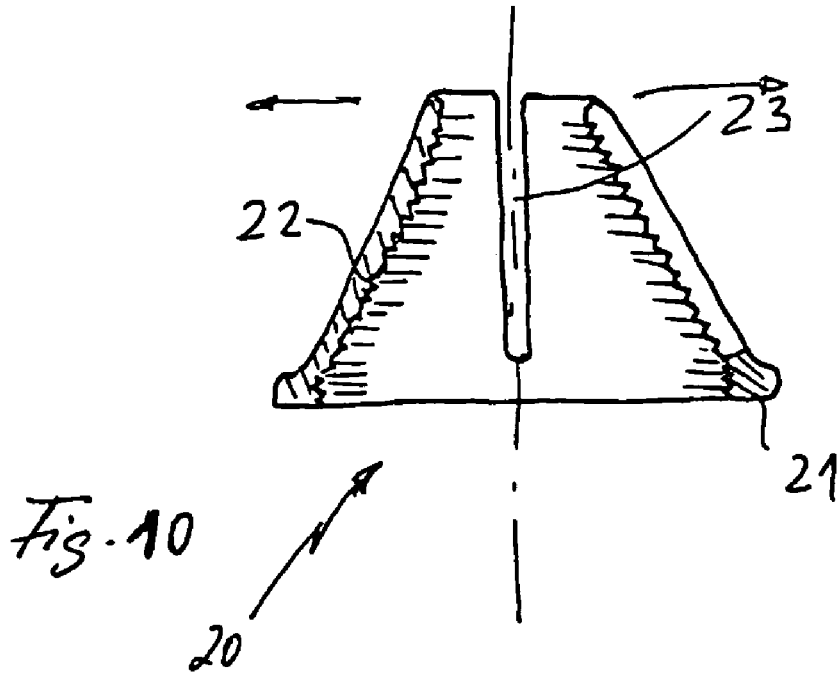
FIG. 10 shows another embodiment of an expandable nut element.

FIG. 10 shows a nut element 20 which is insertable in a closure cap and which consists of a hollow, truncated cone-shaped, injection-molded plastic part. A base ring 21 corresponding to the largest diameter of a screw neck and which does not need to be expanded when screwed on, has on its inner circumference two or three threads on a cylindrical portion, so that this base ring 21 can be directly screwed onto a screw neck having the largest diameter. The circumferential surfaces 22 which start from the base ring 21 and are distributed over the circumference, have on their inner circumference a thread, wherein the individual portions are separated from one another by slits 23, so that during mounting on a screw neck having a medium diameter, the edge of the screw neck comes to bear approximately in the middle area of this nut element, whereupon the circumferential sections 22 are displaced outward in the direction of the arrows when the nut element 20 is screwed onto the screw neck.

The nut element 20 can, for example, be inserted and fixed in a plastic cap by means of a bayonet joint or the like. However, an expandable plastic nut element 20 can also be formed directly on a plastic cap 13.

An essential advantage of a closure cap of the described type consists in that, due to the expandable nut element, the closure cap can be pressed so far down onto the respective screw neck that the flange portion 2 having the surrounding seal abuts on the circumferential surface of the screw neck, whereupon only one additional twisting of the screw with one to two rotations is required to tighten the closure cap and firmly press on the flange portion 2.

According to a further embodiment, the elastically expandable nut element can also be formed as a catch element, so that the plastic cap merely needs to be pressed onto the screw neck to be sealed, wherein the catches corresponding to the thread portions 10 engage with the outer thread of the screw neck and hold the closure cap in the pressed-on position.

Figure 11:
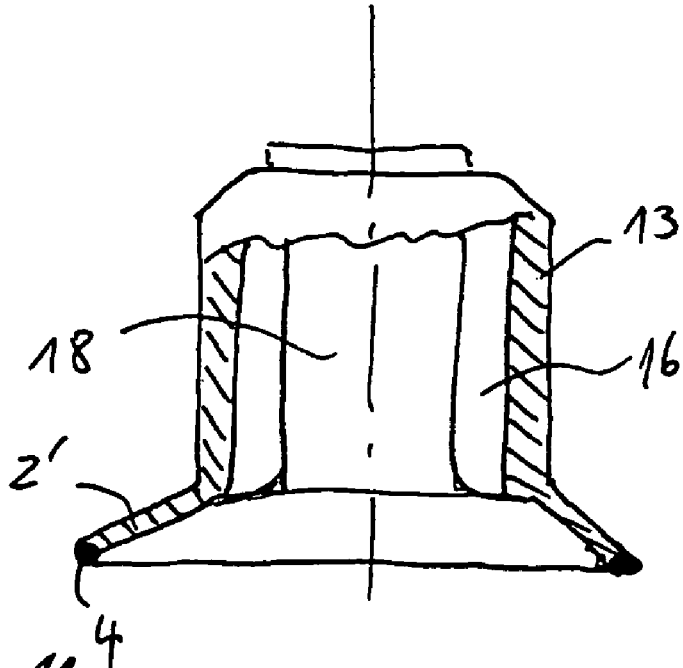
FIG. 11 shows a further embodiment of a cap.

In order that reliable sealing is achieved for this embodiment, the flange portion surrounding the closure cap is formed elastically and preferably provided with a prestress. FIG. 11 shows an embodiment of an approximately truncated cone-shaped flange portion 2' formed on and having a formed-on sealing lip or an O-ring 4 inserted in a groove. When pressing the closure cap onto the screw neck, the conic flange portion is deformed into an approximately horizontal position, so that the sealing lip abuts closely under prestress on the surface surrounding the screw neck, while the catch element inside the closure cap holds the closure cap in the prestressed position.

The catch element can be formed as a spring clip according to FIG. 2, wherein, instead of the engaging portions 10, simple catches can be provided.

The spring clip can be made of spring steel whereas the cap is made of plastic material. The spring clip can also be made of sufficiently strong elastic material.

The invention claimed is:

1. Closure cap, especially for closing the screw neck of an oil filter connection in motor vehicles, wherein in the closure cap an elastically expandable nut element is arranged, which is suitable for being mounted on screw necks of different diameter, such that the nut element engages with the outer thread of a screw neck, wherein the nut element is designed in the form of a two- or multi-arm spring clip formed from a strip of resilient material which is positioned in a rotation-proof way in the closure cap and has spring arms for engagement in the thread of a screw neck, wherein on free ends of the spring arms, a portion is bent inwards for forming an inclined surface, to which a horizontal portion is connected whose free edge is inclined relative to the longitudinal axis for engagement with the thread of a screw neck.

2. Closure cap according to claim 1, wherein a flange portion provided with a ring seal is provided with prestress in the axial direction, wherein the flange portion comes to bear on the surface surrounding the screw neck.

3. Closure cap according to claim 2, wherein the flange portion is formed conically and is elastically deformable.

4. Closure cap according to claim 1, wherein a flange portion is provided which comes to bear on the surface surrounding the screw neck and has a ring seal.

5. Closure cap according to claim 1, wherein the spring arms are positioned inward from the inner surface of the cap to form an air gap between the spring arms and the inner surface of the cap to allow radial motion depending on the diameter of the screw neck when engaging the thread of the screw neck.

* * * * *